US005820116A

United States Patent [19]

Haese

[11] Patent Number: 5,820,116

[45] Date of Patent: Oct. 13, 1998

[54] SUCTION ATTACHABLE RETAINING CLAMP

[76] Inventor: Robert W. Haese, RR 1 PRL 271, Bushkill, Pa. 18324

[21] Appl. No.: 850,372

[22] Filed: May 2, 1997

[51] Int. Cl.[6] ..... B25B 11/00

[52] U.S. Cl. ..... 269/21; 269/95; 269/254 CS; 248/206.3; 248/205.8; 248/362

[58] Field of Search ..... 248/206.3, 206.4, 248/205.7, 205.8, 206.1, 206.2, 208, 316.1, 316.4, 363, 362; 269/21, 95, 254 CS

[56] References Cited

U.S. PATENT DOCUMENTS

| | | | |
|---|---|---|---|
| D. 350,684 | 9/1994 | Campfield | D8/72 |
| 1,466,961 | 9/1923 | Prim | 248/205.7 |
| 2,926,387 | 3/1960 | Lombardo et al. | 269/254 CS |
| 3,207,503 | 9/1965 | Clover, Jr. et al. | 269/21 |
| 3,661,683 | 5/1972 | Engel et al. | 269/21 X |
| 3,770,259 | 11/1973 | Wagreich | 248/362 X |
| 4,197,616 | 4/1980 | Panuski | 248/205.7 X |
| 4,457,503 | 7/1984 | Connor | 269/21 |
| 4,991,807 | 2/1991 | Radnich | 248/206.3 |
| 5,087,005 | 2/1992 | Holoff et al . | 248/205.8 |
| 5,135,206 | 8/1992 | Martinez | 269/21 |

*Primary Examiner*—Ramon O. Ramirez
*Assistant Examiner*—Stephen S. Wentsler

[57] ABSTRACT

A suction attachable retaining clamp for holding an object such as a molding or mounting bracket against a surface such as a windshield. The suction attachable retaining clamp includes a base member having a pair of attachment arms extending from it. Each attachment arm has a suction cup member attached to its extended end for attachment to the surface of a windshield. The suction attachable retaining clamp also has plunger member having a pair guide arms which are inserted into a guide arm bore in each of the attachment arms. The plunger member also has a plunger arm extending from it through a plunger bore in the base member. A clamping foot at the end of the plunger arm is designed for holding an object against the windshield surface. Also attached on the plunger member is a pull ring for pulling the clamping foot in a direction away from surface. A spring member is disposed around the plunger arm and positioned between the clamping foot and the plunger bore shoulder portion to bias the plunger arm in the direction of the windshield surface.

5 Claims, 3 Drawing Sheets

SUCTION ATTACHABLE RETAINING CLAMP

BACKGROUND OF THE INVENTION

1. Field of the Invention

The present invention relates to clamping devices and more particularly pertains to a new suction attachable retaining clamp for holding an object such as a molding or mounting bracket against a surface such as a windshield.

2. Description of the Prior Art

The use of clamping devices is known in the prior art. More specifically, clamping devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art clamping devices include U.S. Pat. No. 4,457,503; U.S. Pat. No. 4,291,866; U.S. Pat. No. Des. 305,394; U.S. Pat. No. 4,497,476; U.S. Pat. No. 5,171,051; and U.S. Pat. No. 4,251,101.

While these devices fulfill their respective, particular objectives and requirements, the aforementioned patents do not disclose a new suction attachable retaining clamp. The inventive device includes a base member having a pair of attachment arms extending from it. Each attachment arm has a suction cup member attached to its extended end for attachment to the surface of a windshield. The suction attachable retaining clamp also has plunger member having a pair guide arms which are inserted into a guide arm bore in each of the attachment arms. The plunger member also has a plunger arm extending from it though a plunger bore in the base member. A clamping foot at the end of the plunger arm is designed for holding an object against the windshield surface. Also attached on the plunger member is a pull ring for pulling the clamping foot in a direction away from surface. A spring member is disposed around the plunger arm and positioned between the clamping foot and the plunger bore shoulder portion to bias the plunger arm in the direction of the windshield surface.

In these respects, the suction attachable retaining clamp according to the present invention substantially departs from the conventional concepts and designs of the prior art, and in so doing provides an apparatus primarily developed for the purpose of holding an object such as a molding or mounting bracket against a surface such as a windshield.

SUMMARY OF THE INVENTION

In view of the foregoing disadvantages inherent in the known types of clamping devices now present in the prior art, the present invention provides a new suction attachable retaining clamp construction wherein the same can be utilized for holding an object such as a molding or mounting bracket against a surface such as a windshield.

The general purpose of the present invention, which will be described subsequently in greater detail, is to provide a new suction attachable retaining clamp apparatus and method which has many of the advantages of the clamping devices mentioned heretofore and many novel features that result in a new suction attachable retaining clamp which is not anticipated, rendered obvious, suggested, or even implied by any of the prior art clamping devices, either alone or in any combination thereof.

To attain this, the present invention generally comprises a base member having a pair of attachment arms extending from it. Each attachment arm has a suction cup member attached to its extended end for attachment to the surface of a windshield. The suction clamp also has plunger member having a pair guide arms which are inserted into a guide arm bore in each of the attachment arms. The plunger member also has a plunger arm extending from it though a plunger bore in the base member. A clamping foot at the end of the plunger arm is designed for holding an object against the windshield surface. Also attached on the plunger member is a pull ring for pulling the clamping foot in a direction away from surface. A spring member is disposed around the plunger arm and positioned between the clamping foot and the plunger bore shoulder portion to bias the plunger arm in the direction of the windshield surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new suction attachable retaining clamp apparatus and method which has many of the advantages of the clamping devices mentioned heretofore and many novel features that result in a new suction attachable retaining clamp which is not anticipated, rendered obvious, suggested, or even implied by any of the prior art clamping devices, either alone or in any combination thereof.

It is another object of the present invention to provide a new suction attachable retaining clamp which may be easily and efficiently manufactured and marketed.

It is a further object of the present invention to provide a new suction attachable retaining clamp which is of a durable and reliable construction.

An even further object of the present invention is to provide a new suction attachable retaining clamp which is susceptible of a low cost of manufacture with regard to both materials and labor, and which accordingly is then susceptible of low prices of sale to the consuming public, thereby making such suction attachable retaining clamp economically available to the buying public.

Still yet another object of the present invention is to provide a new suction attachable retaining clamp which provides in the apparatuses and methods of the prior art some of the advantages thereof, while simultaneously overcoming some of the disadvantages normally associated therewith.

Still another object of the present invention is to provide a new suction attachable retaining clamp for holding an object such as a molding or mounting bracket against a surface such as a windshield.

Yet another object of the present invention is to provide a new suction attachable retaining clamp which includes a base member having a pair of attachment arms extending from it. Each attachment arm has a suction cup member attached to its extended end for attachment to the surface of a windshield. The suction attachable retaining clamp also has plunger member having a pair guide arms which are inserted into a guide arm bore in each of the attachment arms. The plunger member also has a plunger arm extending from it though a plunger bore in the base member. A clamping foot at the end of the plunger arm is designed for holding an object against the windshield surface. Also attached on the plunger member is a pull ring for pulling the clamping foot in a direction away from surface. A spring member is disposed around the plunger arm and positioned between the clamping foot and the plunger bore shoulder portion to bias the plunger arm in the direction of the windshield surface.

Still yet another object of the present invention is to provide a new suction attachable retaining clamp that will hold an object to a surface while a bonding agent sets between the object and the surface.

Even still another object of the present invention is to provide a new suction attachable retaining clamp that securely holds stable a rear view mirror to the inside of a windshield while a bonding agent between them sets thereby keeping an installer's hands free.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
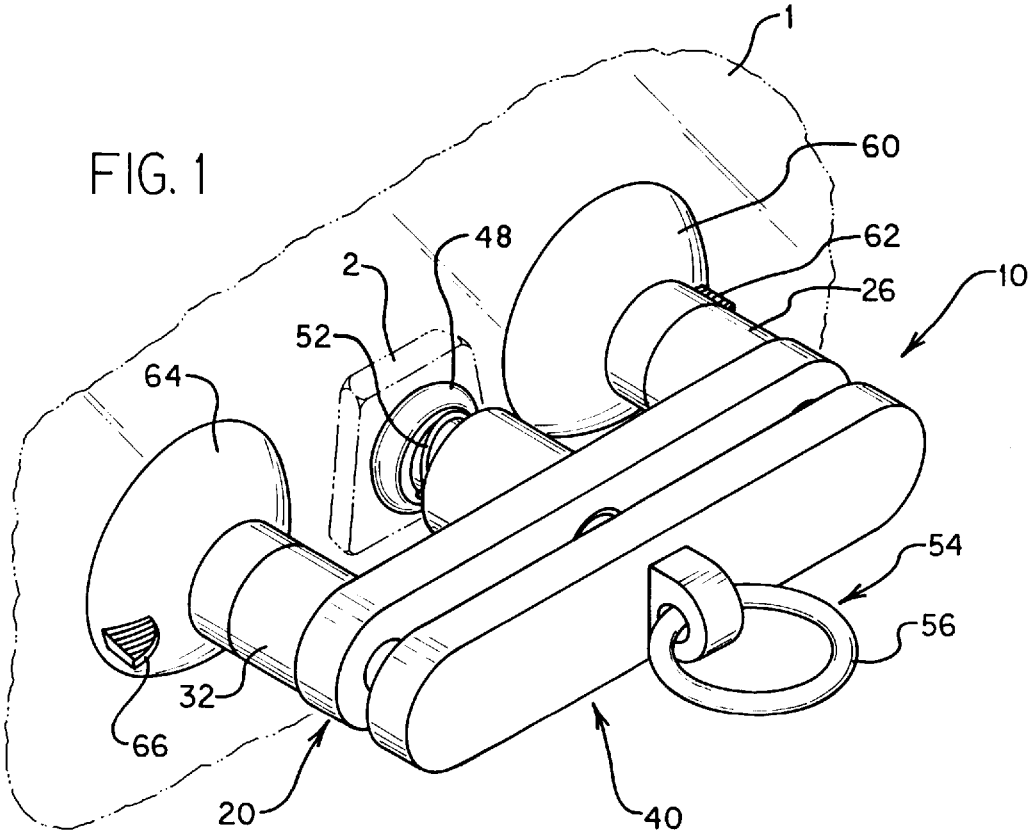
FIG. 1 is a schematic perspective view of a new suction attachable retaining clamp according to the present invention.
Figure 2:
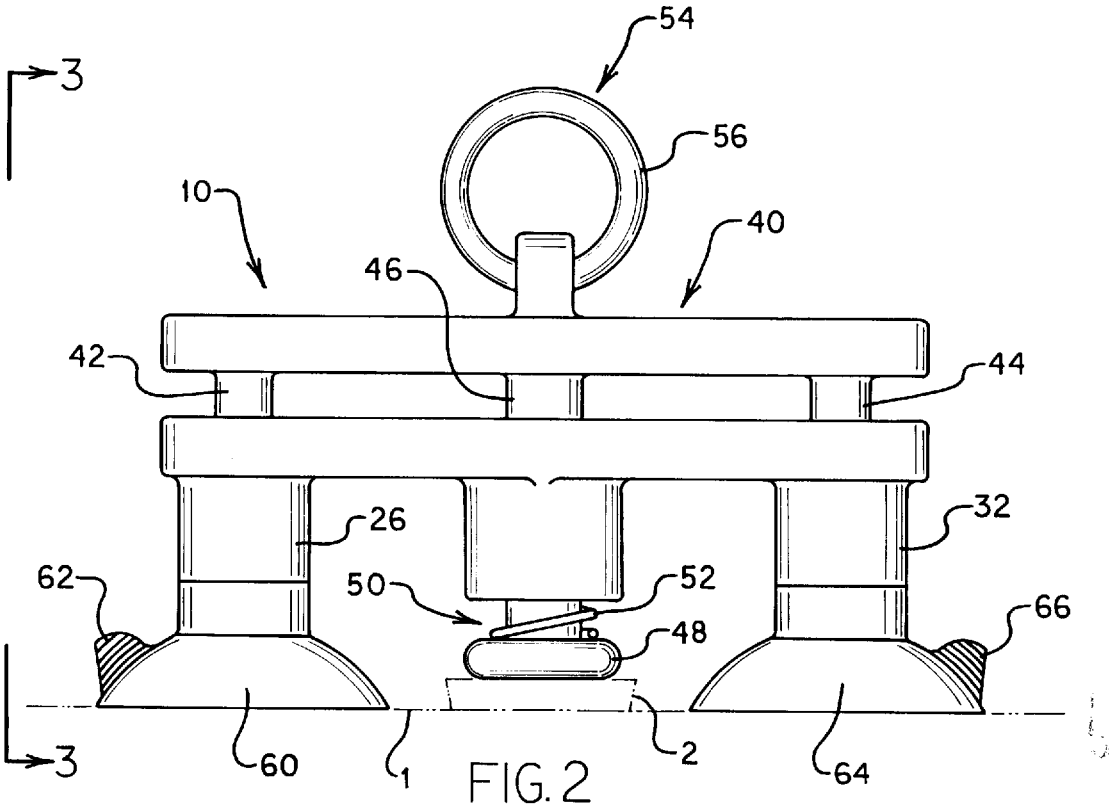
FIG. 2 is a schematic side view of the present invention.
Figure 3:
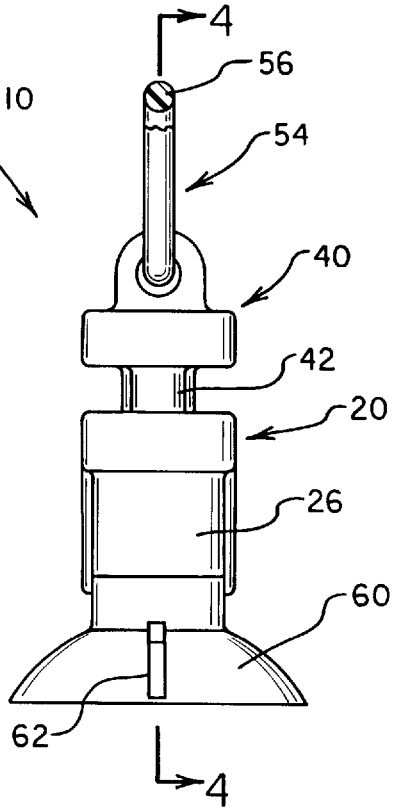
FIG. 3 is a schematic side view of the present invention taken from the vantage of line 3—3 of FIG. 2.
Figure 4:
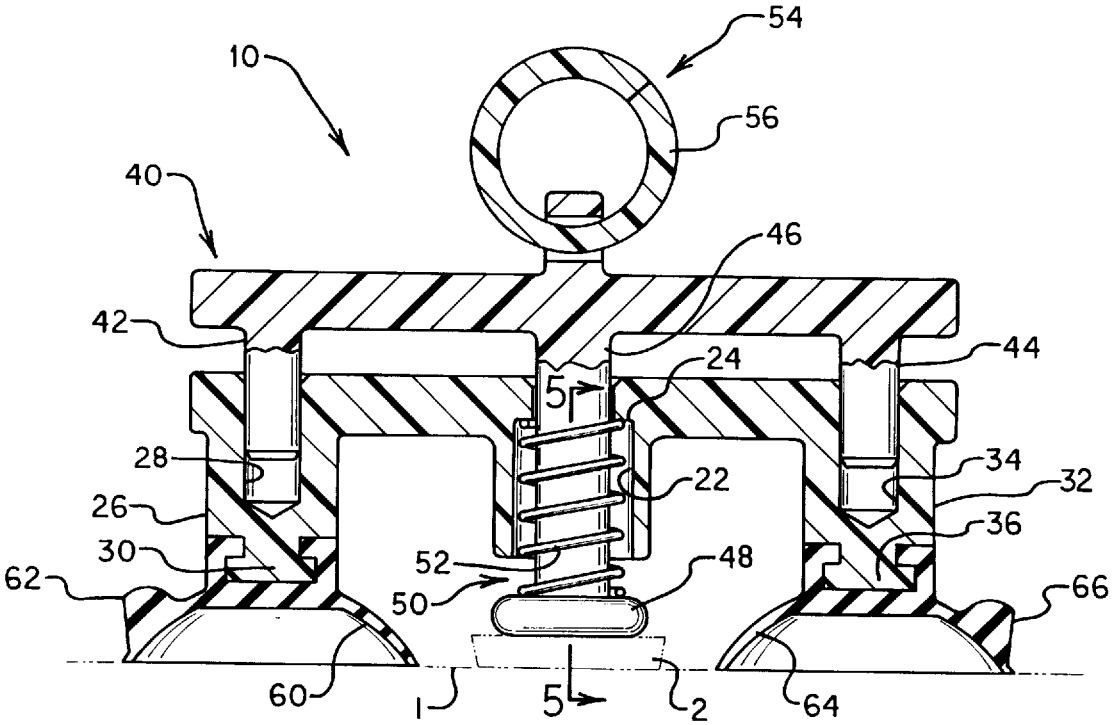
FIG. 4 is a schematic cross-sectional view of the present invention taken from line 4—4 of FIG. 3.
Figure 5:
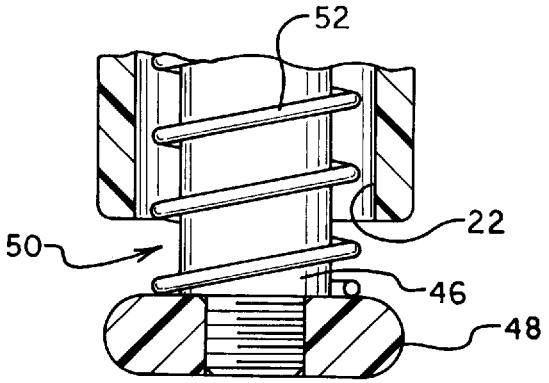
FIG. 5 is a schematic partial cross-sectional view of the plunger arm and spring member taken from line 5—5 of FIG. 4.
Figure 6:
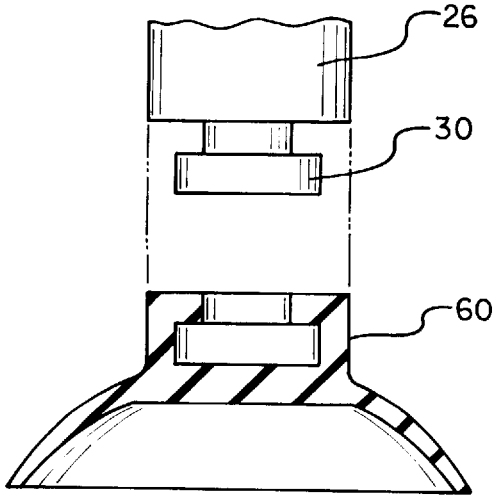
FIG. 6 is a partial exploded sectional view of a section cup member and the suction cup mount of a attachment arm.

With reference now to the drawings, and in particular to FIGS. 1 through 6 thereof, a new suction attachable retaining clamp embodying the principles and concepts of the present invention and generally designated by the reference numeral 10 will be described.

As best illustrated in FIGS. 1 through 6, the suction clamp 10 comprises a base member 20 having at least one attachment arm 26 extended from it for positioning adjacent a surface 1 such as a windshield. Preferably, the base member 20 has two similar attachment arms 26,32 to aid stability of the invention when in use. However, any number of attachment arms may be included on the base member 20. Each attachment arm 26,32 has a guide arm bore 28,34 at one end and a suction cup mount 30,36 at its extended end. The base member 20 also includes a plunger bore 22 which extends through the base member 20.

The suction attachable retaining clamp 10 also includes a plunger member 40 having a guide arm 42,44 which is inserted into each guide arm bore 28,34. As shown in the preferred embodiment, the plunger member 40 has two similar guide arms 42,44 for aiding the stability of the suction clamp 10 while in use. However, the plunger member 40 may include as many guide arms as there are attachment arms with guide arm bores.

The plunger member 40 also includes a plunger arm 46 extending from it. The plunger arm 46 terminates at a clamping foot 48. The clamping foot 48 is designed for holding an object 2 such as a rear view mirror mounting bracket against a surface 1 such as a windshield. The plunger arm 46 is inserted through the plunger bore 22 so that the clamping foot 48 is extending from the plunger bore 22. This allows the clamping foot 48 to be positioned adjacent the object 2 against the desired attaching surface 1.

Also included on the plunger member 40 is a pulling means 54 for pulling the clamping foot 48 in a direction away from surface 1. Preferably, the pulling means 54 is a pull ring 56 attached to the plunger member 40.

Attached to the suction mount cup 30,36 of each attachment arm 26,32 is a suction cup member 60,64. The suction cup members 60,64 are designed for removable attachment to the surface 1 of the windshield. Each suction cup member 60,64 also includes a releasing tab 62,66 for aiding in the detachment of the suction cup members 60,64 from the surface 1.

The suction attachable retaining clamp 10 also includes a biasing means 50 for biasing the plunger arm 46 towards the surface 1 for holding the object 2 against the surface 1. The preferred embodiment of the biasing means 50 is a spring member 52. The spring member 52 is disposed around the plunger arm 46. The spring member 52 is also positioned between the clamping foot 48 and the plunger bore shoulder portion 24 of the base member 20.

In use, the suction attachable retaining clamp 10 allows a user to hold an object 2 against a surface 1. As shown in FIG. 1, the preferred use of the invention is for holding a rear view mirror mounting bracket 2 to the interior side of a windshield 1 while a bonding adhesive sets between the bracket and windshield. The first step in using the suction attachable retaining clamp 10 is to wet both suction cup members 60,64 and then press the suction cup members 60,64 against the surface 1 of the windshield at the desired location. At this point, the clamping foot 48 on the plunger arm 46 is positioned abutting surface 1 of the windshield as well.

The next step is to grip and pull the pull ring 56 so that the clamping foot 48 is pulled back from the windshield surface 1. This allows a user to properly position the rear view mirror mounting bracket 2 with bonding adhesive on it against the windshield surface 1.

Once the rear view mirror mounting bracket 2 is properly positioned, the pull ring 56 is released so the plunger arm 46 is moved back towards the surface 1 and the clamping foot 48 abuts the rear view mirror mounting bracket 2 to hold it in place while the bonding adhesive sets.

After the bonding adhesive has set, the suction clamp 10 is then finally removed from the windshield surface 1 by pulling on the releasing tabs 62,66 to release the suction attachable retaining clamp members 60,64.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, arc deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suction attachable retaining clamp for holding an object against a surface, comprising:

a base member having an attachment arm for positioning adjacent the surface and having a plunger bore being extended through said base member, said attachment arm having a guide arm bore;

a plunger member;

a guide arm disposed from said plunger member;

a plunger arm;

said guide arm being inserted into said guide arm bore, said plunger arm being extended from said plunger member to terminate at a clamping foot for holding the object against the surface, said plunger arm being extended through said plunger bore for positioning said clamping foot adjacent the object against the surface;

a pulling means for pulling said clamping foot in a direction away from the surface, said pulling means being coupled to said plunger member;

a suction cup member for attaching to the surface, said suction cup being coupled to said attachment arm; and a biasing means for biasing said plunger arm towards the surface for holding the object against the surface.

2. The suction attachable retaining clamp of claim 1, wherein said biasing means is a spring member, said spring member being disposed around said plunger arm and being positioned between said base member and said clamping foot.

3. The suction attachable retaining clamp of claim 1, wherein said suction cup member includes a releasing tab for aiding the detaching of said suction cup member from the surface.

4. The suction attachable retaining clamp of claim 1, wherein said pulling means is a pull ring attached to said plunger member.

5. A suction attachable retaining clamp for holding an object against a surface, comprising:

a base member having a pair of attachment arms for positioning adjacent the surface, said base member further having a plunger bore being extended through said base member, each of said pair of attachment arms having a respective guide arm bore, said plunger bore being positioned between said pair of attachment arms;

a plunger member;

a pair of guide arms disposed from said plunger member;

a plunger arm disposed from said plunger member, said plunger arm being positioned between said pair of guide arms;

each of said pair of guide arms being inserted into a respective one of said pair of guide arm bores, said plunger arm being extended from said plunger member to terminate at a clamping foot for holding the object against the surface, said plunger arm being extended through said plunger bore for positioning said clamping foot adjacent the object against the surface;

a pulling means for pulling said clamping foot in a direction away from the surface, said pulling means being coupled to said plunger member;

a pair of suction cup members for attaching to the surface, each of said pair of suction cups being coupled to a respective one of said pair of attachment arms; and a biasing means for biasing said plunger arm towards the surface for holding the object against the surface.

* * * * *